United States Patent [19]

Kloepfer et al.

[11] 4,254,422

[45] Mar. 3, 1981

[54] DIPOLE ANTENNA FED BY COAXIAL ACTIVE ROD

[76] Inventors: Vernon J. Kloepfer, 389 W. Park, Grants Pass, Oreg. 97526; Jimmy B. Russell, Box 204, Sagle, Id. 83860

[21] Appl. No.: 105,583

[22] Filed: Dec. 20, 1979

[51] Int. Cl.[3] ..... H01Q 9/16

[52] U.S. Cl. ..... 343/792; 343/821

[58] Field of Search ..... 343/790, 791, 792, 802, 343/803, 804, 821, 856

[56] References Cited

U.S. PATENT DOCUMENTS

| | | | |
|---|---|---|---|
| 2,648,768 | 8/1953 | Woodward | 343/802 |
| 2,700,112 | 1/1955 | Jasik | 343/792 |
| 3,419,872 | 12/1968 | St. Vrain et al. | 343/792 |
| 3,611,397 | 10/1971 | Poliakoff | 343/792 |

OTHER PUBLICATIONS

The ARRL Antenna Book, Published by American Radio League Inc., 1977, pp. 30, 31, 65-67.

*Primary Examiner*—Eli Lieberman

*Attorney, Agent, or Firm*—Wells, St. John & Roberts

[57] ABSTRACT

An antenna for transmission or reception of broadcast signals has a primary element and a secondary element coupled to one another capacitively and inductively. The primary element has a continuous center conductor surrounded by a concentric conductor interrupted at its midpoint to present two adjacent feed line terminals. The corresponding outer ends of the conductors are electrically joined. The secondary element is parallel to the primary element and overlaps its complete length. It is preferably tubular, to encase and seal the primary element.

12 Claims, 3 Drawing Figures

FIG 1
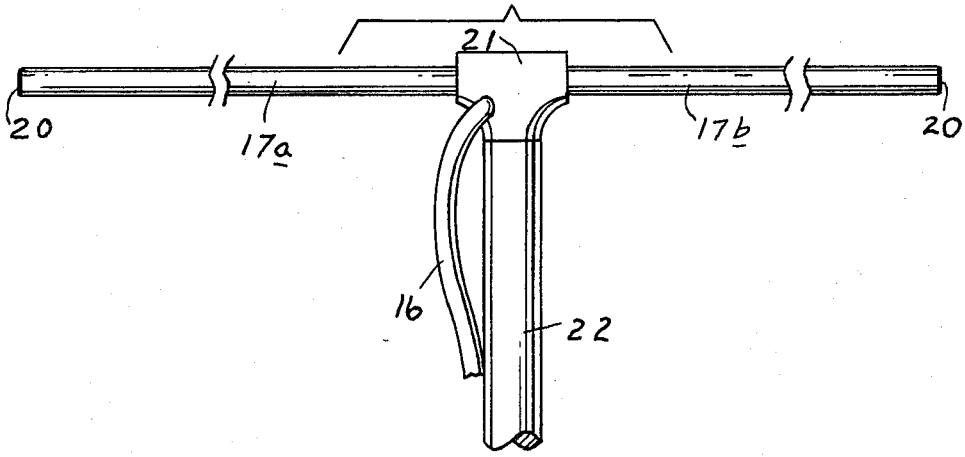
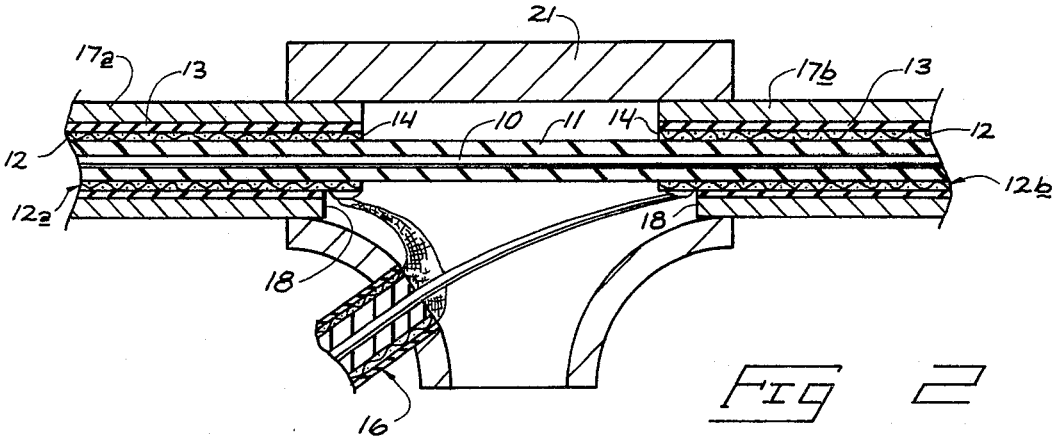
FIG 2
FIG 3
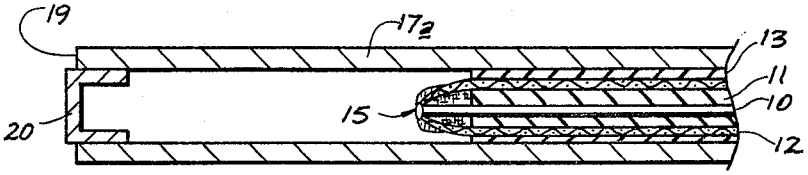

DIPOLE ANTENNA FED BY COAXIAL ACTIVE ROD

BACKGROUND OF THE INVENTION

This disclosure relates to a hybrid antenna that includes a primary antenna element having concentric conductors. The primary antenna element is capacitively and inductively coupled to a secondary antenna element having parallel conductive radiating members. No direct electrical connection is made between the primary and secondary antenna elements. The primary antenna element has a physical length equal to a halfwave section for a selected frequency at its velocity factor. It is center fed. The physical length of the secondary antenna element can be one or more multiples of a halfwave length for the selected frequency, with one or more multiples of a quarter-wave length being arranged to each side of the midpoint of the primary antenna element. When desired, the primary antenna element can be encased and sealed within a tubular secondary antenna element.

The primary antenna element, which combines operational characteristics of a balun, a transformer, and a folded dipole antenna, can be constructed from any concentric conductor assembly having a continuous central conductor surrounded by a spaced outer concentric conductor. An example would be conventional coaxial cable, which might be either flexible line cable or an air-insulated line. The secondary antenna element can be produced from any electrically conductive material having the physical configuration of a wire, rod or tube. In the concentric configuration of the antenna, a suitable material for the secondary antenna element is a straight length of aluminum tubing.

There is no direct electrical connection between the primary and secondary antenna elements in this combination. By isolating the radiating conductor of the secondary antenna element from the primary element or transformer, the antenna has been found to exhibit exceptional ability to resonate over a wide range of frequencies without an appreciable change in the Standing Wave Ratio.

The antenna has been designed for commercial broadcast of reception usage over a broad range of frequencies, including marine, citizen's band and amateur applications.

BRIEF DESCRIPTION OF THE DRAWINGS

FIG. 1 is an elevation view of the antenna, with portions of its total length broken away;

FIG. 2 is a fragmentary central vertical sectional view through the center portion of the antenna; and FIG. 3 is a central vertical section view through one end portion of the antenna.

DESCRIPTION OF THE PREFERRED EMBODIMENT

In general, the antenna includes a primary element that has a continuous center electrical conductor and a surrounding outer electrical conductor concentrically spaced about the center conductor. The primary element might be formed from various types of coaxial cables and other coaxial conductors available commercially or designed specifically for this application. The physical length of the primary element is chosen so as to be equal to a halfwave section for a selected frequency at the velocity factor of the primary element. Each outer end of the center conductor is electrically connected to the corresponding outer end of the outer conductor. The outer conductor is axially interrupted at its midpoint to present two spaced inner ends adapted to be connected respectively to two conductors of a feed line leading to or from the antenna.

The antenna further includes a secondary element of electrically conductive material. The secondary element is arranged parallel to the primary element and overlaps its complete length. The secondary element has no direct electrical connection to the primary element, but is positioned in such close physical proximity to it so as to assure capacitive and inductive coupling between the primary and secondary elements of the antenna. The secondary element will normally comprise one or two electrically connected members, and might include wires, rods, tubular members, vehicle bodies and other types of radiating or receiving elements common to other antenna combinations. For best performance, the length of the secondary element should be one or more multiples of a halfwave section for the selected frequency, with one or more quarter wave sections being arranged to each side of the midpoint of the primary element. In the illustrated embodiment, the secondary element is composed of coaxial tubular members that encase the primary element of the antenna.

The drawings illustrate the primary element as constructed from conventional flexible coaxial cable. This cable includes an inner conductor 10, an interior layer of dielectric or insulation 11, a conductive sheath 12 and an outer layer of electrical insulation 13.

The structure and properties of coaxial cables are well known. A general description can be found in "The ARRL Antenna Book", published by the American Radio Relay League, Inc. of Newington, Connecticut (1977), pages 88 through 92, which are hereby incorporated within this disclosure by reference.

The inner conductor 10 within the coaxial cable is continuous from one end of the cable to the other. It extends between spaced outer ends located at the respective ends of the coaxial cable. The conductive sheath 12 is axially interrupted or separated at the midpoint along the length of the coaxial cable. This interruption is defined by slightly spaced inner ends 14 of the two sheath sections (designated **12*a* and 12*b*). Each sheath section 12*a* or 12*b* leads outwardly from the interruption on the coaxial cable from its inner end 14** to an outer end located at one of the respective ends of the coaxial cable.

The outer ends of the inner conductor 10 are electrically joined or connected to the corresponding outer ends of the two sheath sections **12*a* and 12*b* by a solder joint or other suitable direct connection. These electrical connections are illustrated at 15**.

The inner ends 14 of the sheath sections **12*a* and 12*b* serve as feed connections and are adapted to be connected respectively to the two conductors of a feed line. A typical feed line 16 is shown as a length of coaxial cable having an inner conductor directly connected to the inner end 14 of sheath section 12*a* and having its sheath directly connected to the inner end 14 of the sheath section 14*b***.

The coaxial cable in the antenna serves as a balun, a transformer, and a folded dipole. Its physical length is equal to a halfwave section for a given frequency at its velocity factor. The formula by which this length may be determined is set out below.

The primary element is shown encased within a dipole outer element resonant to the given frequency. The outer element is in the form of two tubular members 17a and 17b. They are made from straight tubular metal stock, such as tubular aluminum. They are coaxial and individually surround the sheath sections 12a and 12b in a concentric relationship.

Tubular members 17a and 17b have inner ends 18 spaced slightly apart at the midpoint of the primary element. They overlap the full length of the primary element. Each tubular member extends outward to an outer end 19 which is situated beyond the location of the outer end of the sheath section which it surrounds. The length of each tubular member can be one or more quarter-wave sections for the selected frequency at which the antenna is designed.

The tubular members 17a and 17b are electrically insulated from the sheath sections 12a and 12b respectively. They are electrically insulated from the inner conductor 10 of the coaxial cable as well. There is no direct electrical connection between the coaxial cable and either tubular member 17a or 17b. The tubular members 17a and 17b are coupled to the coaxial cable through capacitive and inductive coupling, but not through direct electrical connections.

The combined lengths of the tubular members 17a and 17b, including the slight gap at the feed connection for feed lines 16, are electrically resonant to the given frequency for which the antenna is designed. Their total physical length can be one or more multiples of a halfwave section for the selected frequency. This length is determined by conventional formulas which are well known in radio antenna design. Formulas used to determine the length of a "halfwave" antenna by conventional formulas can be found in the above-cited "ARRL Antenna Book" at pages 26 and 27, which are hereby incorporated within this disclosure by reference.

The feed line 16 should preferably be constructed of the same type of coaxial cable used in the antenna. It should be a phasing line of a halfwave length at velocity factor for the coaxial cable or any multiple or harmonic thereof. The design of feed lines to match antenna requirements is well known and not necessary to an understanding of the present invention.

The coaxial cable used in the antenna can be any suitable commercial type. The physical length of the coaxial cable across the antenna must take into account the velocity factor for the particular cable, which reflects the reduced velocity of frequency generation along the cable due to the capacitive reactance between the inner conductor and the outer sheath.

The total length of coaxial cable for a halfwave antenna, including a one inch gap at the midpoint of the sheath, can be mathematically derived from the following formula:

$$l=(468/f)V$$

Where l equals the total length of the coaxial cable in feet, V equals the velocity factor for the type of coaxial cable, and f equals the selected frequency for which the antenna is being designed in Megahertz.

As an example, using conventional 50 Ohm coaxial cable used widely for both amateur and commercial radio use (having a velocity factor of 0.66), the folded dipole inner element of a halfwave dipole antenna for Citizen's Band Channel 16 (27.155 MHZ) would be calculated as follows:

$$(468)(0.66)/27.155=11.37 \text{ feet}$$

For the same antenna, the tubing length for the dipole secondary element would be determined by the standard formula for a resonant antenna having a freespace match, taking into account the usual corrections for end effect. The length would be determined as follows:

$$l=468/27.155=17.23 \text{ feet}$$

There should be as little space as possible between the coaxial cable and the interior of the tubular members so as to minimize radiation losses between them. The inside diameter of the tubular members 17a and 17b is preferably substantially identical to the exterior diameter of the layer of insulation 13 along the outside of the coaxial cable or slightly more than the outside diameter of the conductive sheath 12. This provides tight electrical coupling between the primary and secondary antenna elements and maximum efficiency.

The entire assembly is preferably sealed against weather penetration. This can be accomplished by capping the outer ends of the tubular members 17a and 17b as shown at 20, and by sealing their inner ends 18 and feed line 16 by a suitable bracket 21, made of electrically nonconductive material. Bracket 21 can further be used to support or suspend the antenna on a mast or other suitable structure shown at 22. The sealing of the antenna prevents any possible moisture entrance and enables the antenna to function at the same impedance regardless of weather conditions.

The operation of the antenna is comparable to the operation of an electrical transformer in that there is no direct electrical connection between the two basic elements. They are effectively coupled through capacitive and inductive coupling. The antenna combines the features of two resonant elements: a folded dipole at velocity factor coupled to, but electrically isolated from, a radiating or receiving element.

The purpose of the antenna is to maintain an infinite impedance match while being operated over a broad range of frequencies. It eliminates the requirement of tuning the point of feed or other physical adjustment to the antenna.

Our tests to date have shown extreme broad band characteristics which were unexpected from prior known developments in this field. Tests on an antenna constructed as described above and designed for use in transmission on the amateur Ten Meter Band showed that the antenna maintained an almost constant Standing Wave Ratio from 28 MHz to 30 MHz, or over 2 MHz of coverage. The Standing Wave Ratio of 1:1 measured during use of this antenna on the Ten Meter Band (28 MHz) for which it was designed increased to a ratio of 1.3:1 when the same antenna was used to transmit on the Fifteen Meter Band (21 MHz). This variation is within an acceptable range and illustrates the broad band capabilities of the antenna for amateur radio transmission purposes.

The antenna as described generally herein has been tested in use at frequencies ranging from 1.8 MHz to frequencies above 450 MHz with excellent results. At 450 MHz, the maximum SWR was 2.3:1. Receiving on the antenna has also been acceptable, since the manner of energy transfer in the antenna has an effect similar to that of the original Faraday shield in use for radio reception years ago. The antenna also has a characteristic of rejecting any harmonic radiation and serves as a shield against atmospheric discharge impulses.

The actual receiving or transmitting frequency resonance of the antenna may be fine tuned by simply adjusting the length of the outside tubular members 17*a* and 17*b*. This can be done by the use of telescoping cylindrical slugs (not shown) slidably adjustable at each outer end of the members 17*a* and 17*b* or by telescoping tubular sections. Since there is no direct electrical connection to the exterior tubular members 17*a* and 17*b*, no additional impedance matching need be used.

Almost any type of antenna can be excited by the antenna described in this disclosure. The present antenna is particularly suitable as a driven element in a beam type antenna.

Variations in the specific details of the antenna might be made by one skilled in this field without deviating from the basic invention. Therefore, only the following claims are intended as definitions of the invention disclosed herein.

What is claimed is:

1. In an antenna:

a primary element having a continuous center conductor and a surrounding outer conductor concentrically spaced about the center conductor;

the physical length of the primary element being equal to a halfwave section for a selected frequency at its velocity factor;

the primary element including direct electrical connections between the corresponding outer ends of the center conductor and the outer conductor;

the outer conductor being axially interrupted at its midpoint to present two spaced inner ends adapted to be connected respectively to the two conductors of a feed line;

and a secondary element of electrically conductive material arranged parallel to the primary element and overlapping its length, the secondary element having no direct electrical connection to the primary element, but being in such close physical proximity to it so as to assure capacitive and inductive coupling between the primary and secondary elements of the antenna.

2. An antenna as set out in claim 1 wherein said secondary element is of a length that is resonant to the selected frequency and is one or more multiples of a halfwave section for the selected frequency.

3. An antenna as set out in claim 1 wherein said secondary element is of a length that is resonant to the selected frequency and is one or more multiples of a halfwave section for the selected frequency, and is arranged along the primary element with one or more multiples of a quarter-wave section arranged to each side of the midpoint of the primary element.

4. An antenna as set out in claim 1 wherein the secondary element is tubular and concentrically encases the primary element.

5. An antenna as set out in claim 4 wherein the secondary element has an inside diameter slightly greater than the outside diameter of the outer conductor of said primary element.

6. An antenna, comprising:

a primary element made from a length of coaxial cable including the following concentric layers; an inner conductor, an interior layer of insulation, a conductive sheath, and an outer layer of insulation;

the inner conductor being continuous between spaced outer ends located at the respective ends of the coaxial cable;

the conductive sheath being axially interrupted at the midpoint of the coaxial cable to form two sheath sections leading from individual inner ends spaced slightly apart at said midpoint to individual outer ends located at the respective ends of the coaxial cable;

the inner conductor having its outer ends joined to the corresponding outer ends of the sheath sections;

the length of coaxial cable being equal to a halfwave section for a selected frequency at its velocity factor;

the inner ends of the conductive sheath being adapted to be connected respectively to the two conductors of a feed line;

and a secondary element in the form of electrically conductive members arranged parallel to the primary element and overlapping its length, the secondary element having no direct electrical connection to the primary element, but being in such close physical proximity to it so as to assure capacitive and inductive coupling between the primary and secondary elements of the antenna.

7. An antenna as set out in claim 6 wherein said secondary element is of a length that is resonant to the selected frequency and is one or more multiples of a halfwave section for the selected frequency.

8. An antenna as set out in claim 6 wherein said secondary element is of a length that is resonant to the selected frequency and is one or more multiples of a halfwave section for the selected frequency, and is arranged along the primary element with one or more multiples of a quarter-wave section arranged to each side of the midpoint of the primary element.

9. An antenna as set out in claim 6 wherein the secondary element is tubular and concentrically encases the primary element.

10. An antenna as set out in claim 7 wherein the inside diameter of the secondary element is substantially equal to the outside diameter of the outer layer of insulation on the coaxial cable.

11. An antenna as set out in claim 9 further comprising:

means sealing the respective outer ends of the secondary element.

12. An antenna as set out in claim 6 wherein each of the primary and secondary elements are straight and in coaxial alignment with one another.

* * * * *